United States Patent [19]

Cowger et al.

[11] Patent Number: 5,047,790

[45] Date of Patent: Sep. 10, 1991

[54] CONTROLLED CAPILLARY INK CONTAINMENT FOR INK-JET PENS

[75] Inventors: Bruce Cowger; John H. Dion, both of Corvallis, Oreg.

[73] Assignee: Hewlett-Packard Company, Palo Alto, Calif.

[21] Appl. No.: 464,500

[22] Filed: Jan. 12, 1990

[51] Int. Cl.[5] ..... B41J 2/175

[52] U.S. Cl. ..... 346/140 R; 401/223

[58] Field of Search ..... 346/140, 140 A; 401/223, 199

[56] References Cited

U.S. PATENT DOCUMENTS

| | | | |
|---|---|---|---|
| 2,587,949 | 3/1952 | Zodtner | 401/223 |
| 2,855,989 | 10/1958 | Dyson | 401/223 X |
| 3,296,624 | 1/1967 | Ascoli . | |
| 3,438,058 | 4/1969 | Davis | 346/140 A |
| 3,452,361 | 6/1969 | Williams, Jr. . | |
| 4,149,172 | 4/1979 | Heinzl et al. . | |
| 4,183,030 | 1/1980 | Kaieda | 346/140 |
| 4,207,012 | 6/1980 | Kuparinen . | |
| 4,217,058 | 8/1980 | Straszewski et al. . | |
| 4,272,773 | 6/1981 | Halasz . | |
| 4,342,042 | 7/1982 | Cruz-Uribe et al. . | |
| 4,382,707 | 5/1983 | Anderka . | |
| 4,412,232 | 10/1983 | Weber et al. . | |
| 4,422,084 | 12/1983 | Saito . | |
| 4,436,439 | 3/1984 | Koto . | |
| 4,490,728 | 12/1984 | Vaught et al. . | |
| 4,500,895 | 2/1985 | Buck et al. . | |
| 4,509,062 | 4/1985 | Low et al. . | |
| 4,539,568 | 9/1985 | Lewis . | |
| 4,571,599 | 2/1986 | Rezanka . | |
| 4,671,692 | 6/1987 | Inaba . | |
| 4,673,955 | 6/1987 | Ameyama et al. . | |
| 4,677,447 | 6/1987 | Nielsen . | |
| 4,714,937 | 12/1987 | Kaplinsky . | |
| 4,719,678 | 12/1983 | Kasugayama et al. . | |
| 4,771,295 | 9/1988 | Baker et al. . | |
| 4,791,438 | 12/1938 | Hanson et al. . | |
| 4,794,409 | 12/1988 | Cowger et al. . | |
| 4,920,362 | 4/1990 | Cowger | 346/140 |
| 4,929,969 | 5/1990 | Morris | 346/140 |

OTHER PUBLICATIONS

Robert C. Dureck et al., (Output Hardcopy Devices, Academic Press 1988) Chapter 13, "Ink Jet Printing" by William J. Lloyd et al.

Hewlett-Packard Journal, vol. 36, No. 5 (May 1985), pp. 1-27.

*Primary Examiner*—Joseph W. Hartary

[57] ABSTRACT

Ink contained in a pen reservoir (12) is subject to the capillarity provided by an array of spaced apart capillary members (10). The capillarity provided by the capillary members (10) is sufficient for establishing a back pressure at the print head (18) of the pen (14) to thereby avoid leakage of ink from the reservoir (12) whenever the print head (18) is inactive.

3 Claims, 2 Drawing Sheets

CONTROLLED CAPILLARY INK CONTAINMENT FOR INK-JET PENS

TECHNICAL FIELD

This invention pertains to containment of ink in pens that are used for ink-jet printing.

BACKGROUND INFORMATION

Ink-jet printing has become an established printing technique and generally involves the controlled delivery of ink drops from an ink containment structure, or reservoir, to a printing surface.

One type of ink-jet printing, known as drop-on-demand printing, employs a pen that has a print head that is responsive to control signals for ejecting drops of ink from the ink reservoir. Drop-on-demand ink-jet printers typically use one of two mechanisms for ejecting drops: thermal bubble or piezoelectric pressure wave. The print head of a thermal bubble type pen includes a thin film resistor that is heated to cause sudden vaporization of a small portion of the ink. The rapid expansion of the ink vapor forces a small amount of ink through a print head orifice.

Piezoelectric pressure wave systems use a piezoelectric element that is responsive to a control signal for abruptly compressing a volume of ink in the print head to thereby produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require a slight back pressure at the print head to prevent ink from leaking through an inactive print head.

One prior technique for providing sufficient back pressure at the print head is described in U.S. Pat. No. 4,771,295, issued to Baker et al. The system in Baker et al. employs a porous synthetic foam within the ink reservoir. The capillarity of the foam provides the back pressure necessary for preventing the ink from permeating through the print head whenever the print head is inactive.

One problem associated with the use of foam for establishing back pressure at the print head is that some of the ink in the reservoir will become trapped in the very small pores of the foam. Specifically, pore size in foam varies throughout the volume of the foam. The very small pores in the foam exert on the ink a correspondingly strong capillarity that cannot be overcome by the pumping effect of a conventional print head. Any amount of ink that remains trapped in the pen reduces the volumetric efficiency of the pen, which efficiency can be quantified as the interior volume of the pen divided by the total volume of the ink that is delivered by the print head.

SUMMARY OF THE INVENTION

This invention pertains to an apparatus that provides a controlled amount of capillarity within the ink containment structure of an ink-jet pen. The apparatus of the present invention includes an array of capillary members that are arranged to introduce a substantially uniform capillarity throughout the reservoir. Consequently, the capillary members do not include any regions of high capillarity that retain ink despite the pumping action of the print head. As a result, the volumetric efficiency of the ink-jet pen is increased over what was obtainable by heretofore available ink containment mechanisms.

As another aspect of this invention, means are provided for ensuring that the pumping action or suction provided by the print head is maintained until substantially all of the ink is removed from the reservoir.

DETAILED DESCRIPTION

Figure 1:
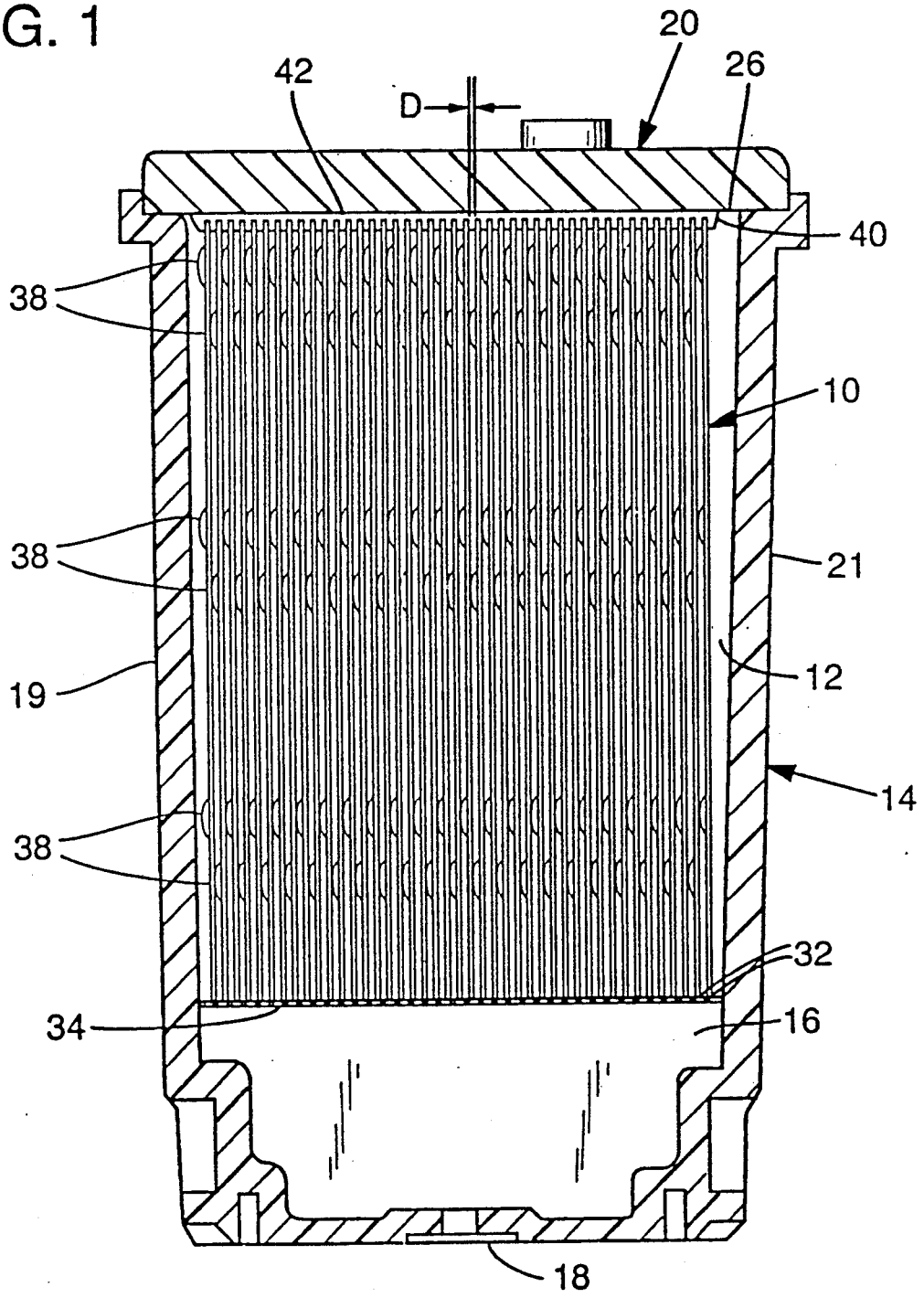
FIG. 1 is a front cross-sectional view, in partial schematic, of an ink-jet pen employing the containment apparatus of the present invention.
Figure 2:
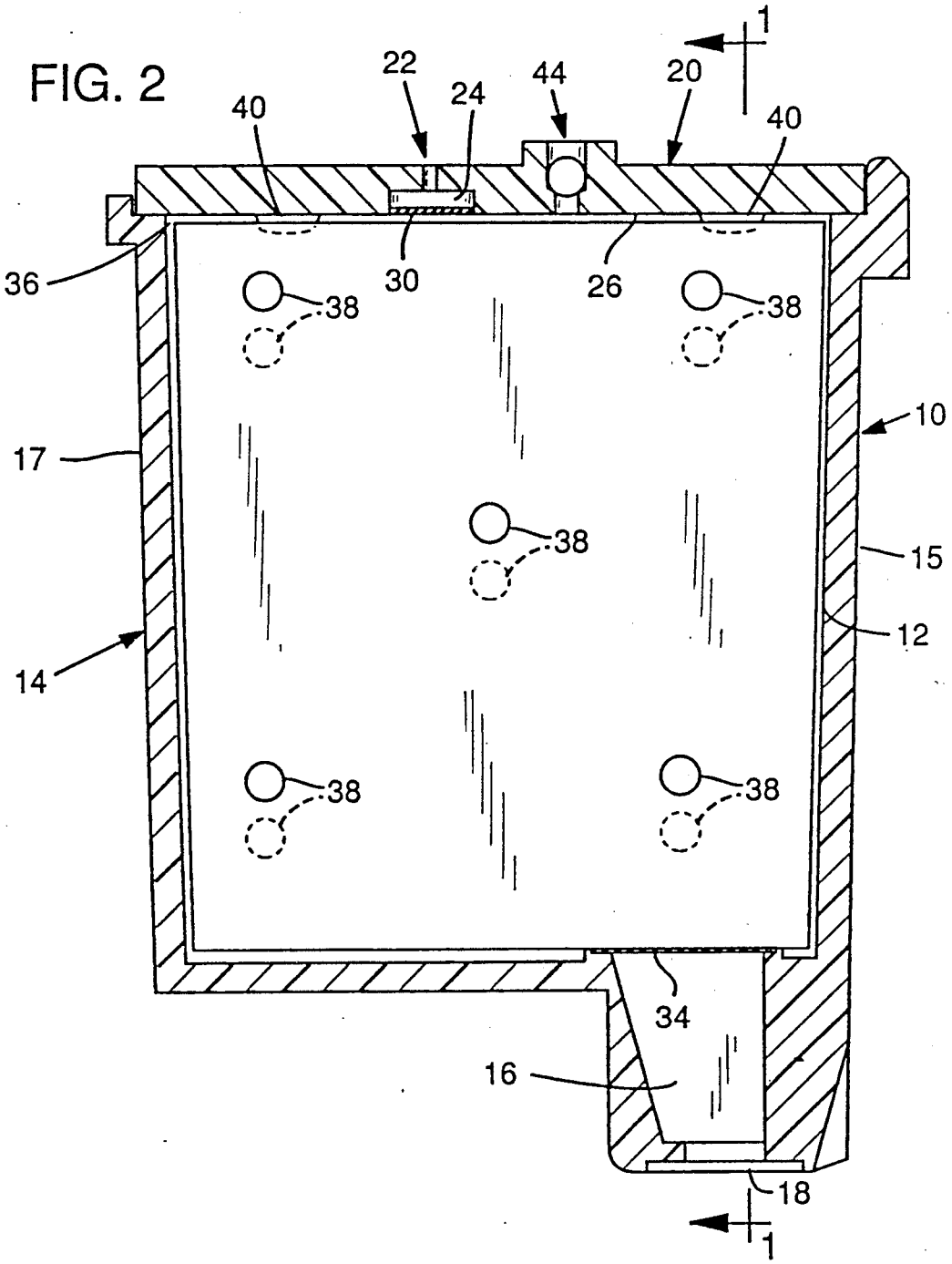
FIG. 2 is a side cross-sectional view of the ink-jet pen of FIG. 1.

With reference to FIGS. 1 and 2, a preferred embodiment of the present invention generally comprises an array of spaced-apart capillary members 10 positioned within the reservoir 12 of an ink-jet pen 14. The reservoir 12 is shaped near the front 15 of the pen to include a downwardly extending well 16. A conventional print head 18 of the drop-on-demand type is mounted to the reservoir 12 in the base of the well 16.

The top 20 of the ink-jet pen 14 is sealed to the remaining portion of the reservoir 12 and includes a vent 22 that vents to ambient the fluid pressure within the reservoir 12. The vent 22 comprises a recess 24 formed in the interior surface 26 of the reservoir top 20. A port 28 extends from the recess 24 through the top 20 to provide fluid communication between the recess 24 and ambient air.

The recess 24 is covered with an air-porous membrane 30 formed of, for example, polytetrafluroethylene of sufficient density to prevent ink from flowing through the vent 22 in the event pen 14 is inverted. Preferably, the port 28 is of a diameter and length that is suitable for restricting water vapor loss from the reservoir 12.

The print head 18 is activated by known means to eject ink drops from the print head orifices (not shown). Gravitational force acting on the ink contained in the reservoir 12 will, in the absence of a counteracting force, cause the ink to permeate through the inactive print head 18. Consequently, it is necessary to design the pen 14 to include a constant back pressure at the print head 18 to keep ink from permeating (i.e., leaking) through the print head 18 whenever the print head is inactive. The present invention is directed to an apparatus that provides the necessary back pressure, without significantly reducing the volumetric efficiency of the pen 14.

The capillary members 10 of the present invention are thin, flat sheets of wettable material such as stainless steel having a thickness of about 75 $\mu$. Alternatively, the sheets may be formed of plastic films that have wettable outer surfaces. For example, a polyester film coated with a thin layer of polyethylene would be suitable as a capillary member 10. Moreover, plasma polymerization techniques may be employed in producing a sheet of material having a wettable surface. For example, a methane plasma may be generated and, in accordance with conventional plasma polymerization techniques, deposited under high pressure onto a suitable substrate. The consequent cross-linked molecular structure on the substrate surface provides the wettable surface (i.e., high surface energy) necessary for the capillary members 10.

As shown in FIG. 2, the capillary members 10 are rectangular shaped and sized to extend substantially between the front 15 and back 17 of the reservoir 12 and substantially between the left side 19 and right side 21 of the reservoir 12 (FIG. 1).

Near the front 15 of the reservoir, the bottom edges 32 of the capillary members 10 extend across and bear upon a fine-mesh screen 34 that is mounted to the reservoir 12 to completely cover the upper end of the well 16. As will become clear upon reading this description, the screen 34, in addition to preventing foreign particles from reaching the print head 18, provides a capillarity control feature.

The distance D (FIG. 1) between the surfaces of the capillary members 10 is selected to produce capillarity that is sufficient to keep the ink in the reservoir 12 from permeating through the print head 18 whenever the print head is inactive.

Preferably, the capillarity produced by the capillary members 10 is sufficient to counteract the maximum static fluid pressure head that can arise at the print head 18 as a result of gravitational force acting on the ink within the reservoir 12. In this regard, it can be appreciated that the maximum static pressure head at the print head 18 will arise whenever the pen is tipped so that the longest column of ink within the reservoir is directly above the print head 18.

More particularly, when reservoir 12 is filled with ink, the greatest static pressure head is present at the print head 18 whenever the pen 14 is tipped (for example, during shipment) so that the point 36 (FIG. 2) in the reservoir that is most distant from the print head 18 is directly above the print head 18. In a preferred embodiment, tipping a filled pen as just described will produce a static pressure head at the print head 18 of approximately 5 cm. Consequently, the capillarity C provided by the capillary members 10 must be greater than 5 cm. As is known, capillarity or capillary draw may be calculated as follows:

$$C=(\sigma/\gamma*(D/2))$$

where $\sigma$ is the surface tension of the liquid in the reservoir; $\gamma$ is the specific weight of the liquid; and D is the spacing between the surfaces of the capillary members. This equation assumes perfect wetting of the liquid to the capillary members and disregards gravitational distortion of the meniscus. Assuming that the ink has a surface tension (0.0731 N/m) and specific weight (9802 $N/m^3$) very near water, the spacing D necessary to overcome a 5 cm maximum gravitational pressure head is calculated from the above equation as 300 $\mu$.

It is noteworthy that the capillarity provided by the capillary members 10 is strong enough to keep the ink from permeating through the print head 18, but is not so strong as to prevent the print head from "pumping" ink from the reservoir whenever the print head 18 is activated. In this regard, conventional print heads 18 will function properly with back pressure heads as high as approximately 25 cm.

The reservoir 12 is filled with ink through an opening 44 that is later plugged. Preferably, the reservoir is filled in a manner that eliminates air voids within the well 16. Such voids are eliminated by filling the pen reservoir 12 and then inverting the pen to remove through the print head 18 any air that may be trapped in the well 16. After the air is removed from the well, additional ink may be added to completely fill the well. Immediately after filing, a small amount of ink is ejected through the print head 18 to establish the back pressure in the pen, which back pressure is thereafter maintained by the capillarity provided by the capillary members 10.

The spacing D is uniformly maintained between the capillary members 10 through the use of embossed spacers 38 formed to protrude the distance D from the surface of each capillary member 10. A small number (for example, 5) of spacers 38 are distributed over the area of each capillary member 10. Preferably, the spacers 38 are distributed differently on adjacent capillary members 10 so that the spacers 38 on one capillary member will not nest with the spacers 38 of the adjacent capillary member.

It is contemplated that any of a number of mechanisms can be employed to maintain the above-described spacing D. For example, the corners of the capillary members 10 may be bent to protrude outwardly from the capillary members by a distance D. Moreover, the spacers 38 may be discrete components that are bonded or otherwise attached to the capillary members 10.

As noted earlier, a portion of the bottom edges 32 of the capillary members 10 bear upon the screen 34 that covers the well 16. As will be described later, it is desirable to keep these portions of the bottom edges 32 in continuous contact with the screen 34. To this end, two elongate beads 40 of elastomeric material are disposed beneath the internal surface 26 of the reservoir top 20 to engage the upper edges 42 of the capillary members 10. The elastomeric beads 40 extend substantially perpendicular to the planes of the capillary members 10 and provide a downward elastic force that urges the bottom edges 32 of the capillary members 10 against the screen 34. Moreover, the beads 40 tend to keep the array of capillary members 10 from shifting laterally within the reservoir 12.

It is contemplated that other mechanisms would be suitable for urging the bottom edges 32 of the capillary members into contact with the screen 34. For example, the beads 40 could be formed integrally with the top 20 of the pen to protrude from the internal surface 26.

Immediately after the pen reservoir is filled, the print head 18 will not be in communication with ambient air in the reservoir. Consequently, the print head 18 is primed for generating sufficient suction for ejecting ink from the reservoir 12.

It can be appreciated that slight variations in the spacing D between capillary members 10 will cause variations in the capillarity established between pairs of capillary members. Consequently, ink that is between relatively wider spaced capillary members 10 will be withdrawn by the pumping action of the print head 18 before the print head withdraws ink that is between relatively narrow spaced capillary members 10. Moreover, ambient air passing into the reservoir 12 through vent 22 will pass through the void remaining between two capillary members 10 after the ink between those members is withdrawn. If the print head 18 is exposed to ambient air entering the reservoir, the suction in the print head would be lost (i.e., the print head would deprime). Any ink still held between any capillary members 10 at the time that the print head 18 deprimes would be stranded in the reservoir 12.

The contacting arrangement of the screen 34 and capillary members 10 of the present invention effectively avoids the ink-stranding problem just described because ambient air in the reservoir 12 is prevented from reaching the print head 18. Consequently, substantially all of the ink in the reservoir 12 is ejected by the print head 18.

More particularly, the screen 34 is formed of a sintered stainless steel mesh having apertures that are substantially smaller in cross section than the spacing D between the capillary members 10. Preferably, the screen aperture size is small enough (for example, 25 $\mu$) so that as the ink in the space immediately above a particular screen aperture is depleted (i.e., through the pumping action of the print head 18) to the level of the screen 34, the capillarity that is established in the aperture at the ink/ambient air interface will be substantially greater (for example, 50 cm head) than the capillarity between any pair of capillary members 10. Consequently, all of the ink within the reservoir 12 will be pumped by the print head 18 before the print head deprimes because the capillarity at the screen apertures is strong enough to retain ink within the screen 34 to block the passage of ambient air to the print head 18.

It is noteworthy that, after the reservoir is emptied of ink by the print head 18, only a minute amount of ink remains in the thin filter screen 34. Accordingly, the volumetric efficiency of the pen is only nominally reduced by the ink remaining on the screen 34 and in the well 16.

Preferably, the volume of the well 16 is small, since ink in this region is not readily usable at the end of the pen's life. However, the well must be large enough to permit ink to be drawn by the print head past any air bubbles that may collect within the well.

Having described and illustrated the principles of the invention with reference to a preferred embodiment and alternatives, it should be apparent that the invention can be further modified in arrangement and detail without departing from such principles. For example, the capillary members of the present invention can be used in conjunction with a three-color ink-jet pen that is formed with separate reservoir cavities, filter screens and wells that lead to a common trifurcated print head.

We claim:

1. A containment apparatus comprising:

a reservoir for storing liquid, the reservoir including a liquid-permeable part;

an array of spaced apart capillary sheets disposed within the reservoir and arranged to provide capillarity sufficient to prevent liquid in the reservoir from permeating through the liquid-permeable part; and a screen disposed between the capillary sheets and the liquid-permeable part, the screen providing capillarity that is greater in magnitude than the capillarity provided by the capillary sheets for holding liquid within the screen after liquid is removed from between the capillary sheets.

2. The apparatus of claim 1 wherein the magnitude of the capillarity provided by the capillary sheets is greater than the maximum static fluid pressure head that can be developed in the reservoir.

3. The apparatus of claim 1 wherein the capillary sheets are mounted within the reservoir in contact with the screen.

* * * * *